United States Patent [19]

Tomita et al.

[11] Patent Number: 4,562,685

[45] Date of Patent: Jan. 7, 1986

[54] BOTTLE CAPPING APPARATUS

[76] Inventors: Yoshiaki Tomita, 1393, Johsuishinmachi, Kodaira-shi, Tokyo; Toshio Ohtsuka, 6-12, Fukazawa 8-chome, Setagaya-ku, Tokyo; Yasunori Tanaka, 3-341 Nobadanchi, Noba-cho, Konan-ku, Yokohama-shi, Kanagawa-ken, all of Japan

[21] Appl. No.: 576,102

[22] Filed: Feb. 2, 1984

[51] Int. Cl.[4] ..... B67B 3/14; B65B 7/28

[52] U.S. Cl. ..... 53/201; 53/353

[58] Field of Search ..... 53/485, 488, 344, 351, 53/352, 353, 368, 201

[56] References Cited

U.S. PATENT DOCUMENTS

| | | | |
|---|---|---|---|
| 2,544,626 | 3/1951 | Zimmermann | 53/352 X |
| 2,641,398 | 6/1953 | Barrett | 53/368 X |
| 2,668,650 | 2/1954 | Wilson | 53/368 X |
| 3,672,121 | 6/1972 | Kawaminani | 53/351 |
| 3,950,922 | 4/1976 | Eberhardt | 53/368 X |

*Primary Examiner*—Horace M. Culver

[57] ABSTRACT

A method and apparatus for alternately capping both glass and semirigid plastic bottles. A mechanically actuated cap applying head is mounted for vertically reciprocating movement so as to apply a downwardly directed capping force on the bottle. A hand manipulated dual position stop mechanism limits the downwardly directed capping force in one mode to accommodate semirigid containers and in the other mode removes the downward force restraint for capping glass bottles.

4 Claims, 5 Drawing Figures

BOTTLE CAPPING APPARATUS

BACKGROUND OF INVENTION

This invention is directed to a method and apparatus for capping bottles.

Presently existing mechanical bottle capping equipment commonly employed for capping glass bottles has not been suited for capping semirigid plastic bottles due to the inability of plastic bottles to withstand the excessive downward force exerted during the capping operation. One type of capping equipment includes a vertically reciprocating crimping head having a centrally disposed plunger mechanism which terminates at its lowermost end in a bottle cap engaging seat. This seat is surrounded by a series of crimping jaws which are in turn surrounded by a camming sleeve adapted to pivot the jaws radially inwardly against the cap skirt upon lowering the sleeve relative to the plunger mechanism.

This relative axial movement requires a substantial downwardly directed force which must be supported by the bottle when using prior art mechanically actuated bottle capping equipment. Then walled plastic beverage bottles do not have sufficient structural rigidity to counteract these forces. One approach to overcoming this problem includes molding a circumferentially enlarged ring about the bottle neck which is then used as a support during the capping operation. While the support ring arrangement is common with the larger size bottles, it has certain inherent drawbacks, particularly with the higher volume smaller size bottles such as increased weight and resin usage, handling instability and design aesthetics.

Another approach is to isolate the horizontal and vertical force components developed during the capping operation. While this can be accomplished through the use of hydraulic or pneumatic actuating mechanisms, the cost and practicality of doing so weigh heavily against it.

SUMMARY OF THE INVENTION

The method and apparatus of the invention overcome the above mentioned problems by limiting the downward force applied to the relatively fragile plastic bottle during the capping operation. This is accomplished by lowering a bottle capper crimping head onto a plastic bottle and cap seated thereon, with just sufficient downward force to compress the cap gasket. As soon as the crimping head descends a predetermined fixed distance, a stop is engaged limiting the downward travel of the crimping head plunger mechanism. Continued downward movement of the crimping head causes the outer camming sleeve to actuate the crimping jaws by application of a horizontal force component only. The vertical force component instead of acting directly on the plastic bottle is harmlessly restrained by the stop. Consequently, capping lightweight plastic bottles is readily accomplished without resort either to undersirable neck support rings or more costly fluid actuating mechanisms.

Moreover, interchangeably capping glass and plastic bottles is easily accomplished with the invention through the provision of a hand manipulated dual position stop mechanism. In one position, downward movement of the centrally disposed crimping plunger mechanism is restrained for capping plastic bottles and in the other position, the plunger mechanism is unrestrained for capping glass bottles as is normally done.

It is accordingly a principal object of the invention to provide a new apparatus for mechanically capping lightweight plastic bottles through application of controlled vertical force loading on the bottle.

Another object is to provide a new apparatus for interchangeably capping both glass and semirigid plastic containers.

A more detailed object is to provide a hand manipulated dual position stop mechanism in conjunction with bottle capping machinery for selectively limiting the downward travel distance of the cap applying head to accommodate either glass or plastic bottles.

Other and more detailed objects will in part be obvious and in part pointed out as the description of the invention taken in conjunction with the accompanying drawing proceeds.

DESCRIPTION OF THE PREFERRED EMBODIMENT

Figure 1:
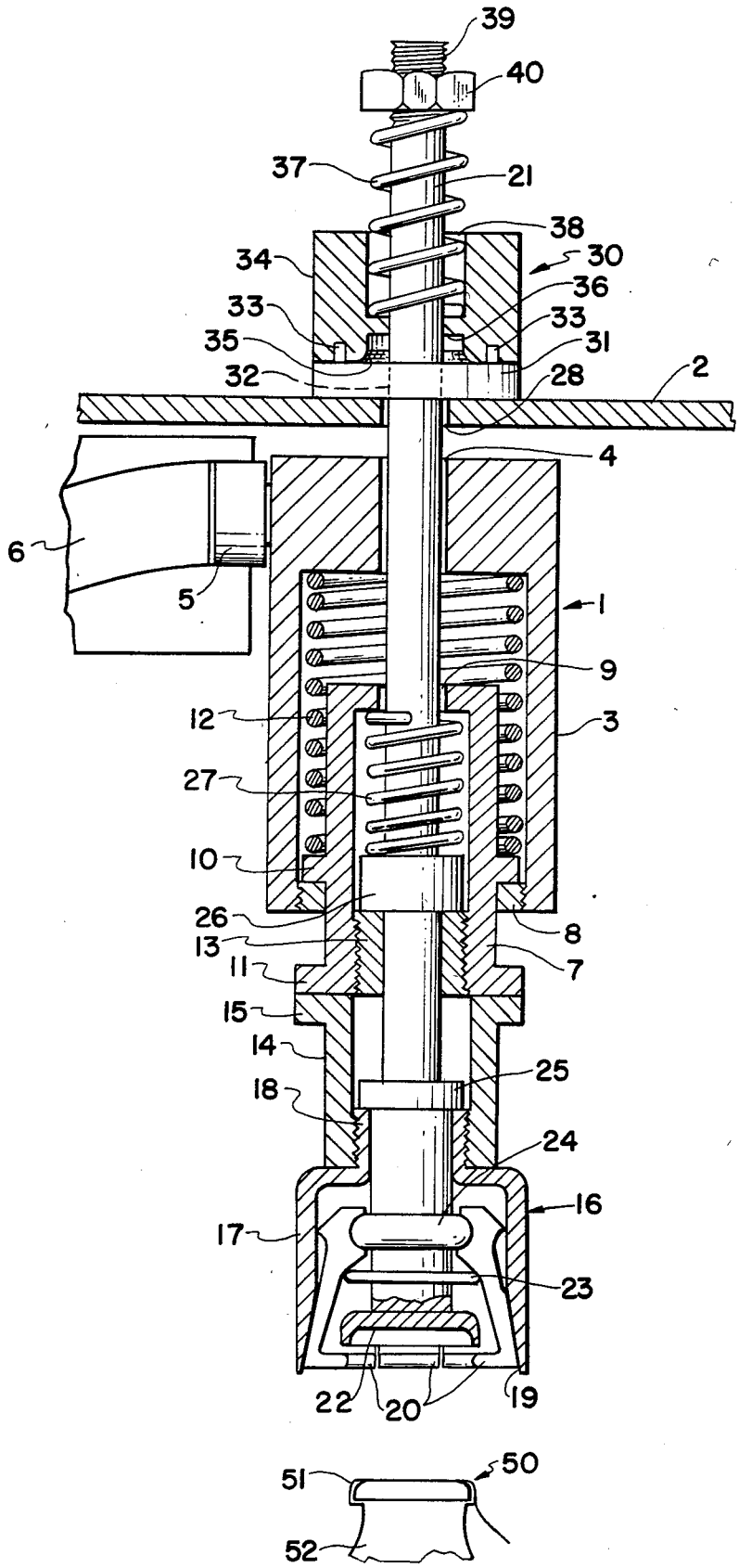
FIG. 1 is a part elevational part sectional view of a cap applying mechanism in accordance with the invention positioned above a bottle with cap seated thereon.

The capping unit 1 of the invention may be mounted either singly or as one of a series in a rotating turret (not shown) having a top support wall 2. The capping unit 1 consists of an outer cylindrical member 3 having a reduced bore 4 at its upper end portion. A cam follower 5 is mounted on the cylindrical member upper end portion for travel within a circular cam race 6 designed to impart vertical reciprocating motion to the capping unit 1. A cylindrical compensator slide 7 extends telescopically within the lower end of cylindrical member 3 and is retained therewithin by a threaded bushing 8. The compensator slide 7 also has a reduced bore 9 at its upper end and is further provided with an intermediate stop collar 10 and a lowermost mounting flange 11. A relatively heavy coil compression spring 12 is housed within the cylindrical member 3 so as to surround the compensator slide 7 and urge the collar 10 downwardly against the bushing 8. The lowermost end of the compensator slide is fitted with a hollow threaded bushing 13. An adaptor 14 having an upper end flange 15 is secured to the slide mounting flange 11.

A closure crimping head 16 is threadedly secured to the lower end of adaptor 14 and includes a housing 17 with a threaded upper securing neck 18. An inclined camming surface 19 is formed on the lower interior portion of the housing 17 which coacts with a series of circumferentially arranged crimping jaws 20 in a manner described hereinafter.

An elongated plunger rod 21 extends centrally through the capping unit 1 commencing at its lowermost end in a closure cap receiving nest 22. A flexible collar 23 surrounds the plunger rod 21 just above the nest 22 and acts as a spring for urging the jaws 20 to an open or expanded position. An annular pivot ring 24 surrounds the rod 21 just above the collar 23 about which the jaws are supported for pivotal movement relative to the cap nest 22. A connecting ring 25 is disposed at the upper end of the housing neck 18 joining upper and lower positions of the plunger rod 21. A shoulder stop is formed on the plunger rod spaced above the ring 25. A coiled compression plunger spring 27 surrounds the plunger rod 21 within the compensator slide 7 and urges the shoulder stop 26 downwardly against the bushing 8.

The plunger rod 21 then extends through the bore 9 in compensator slide 7 and through the bore 4 in cylinder member 3 thus extending completely through the capping unit 1. Rod 21 further extends through an aperture 28 in the top support wall 2 where it is surrounded by a dual position stop mechanism generally indicated at 30.

Figure 2:
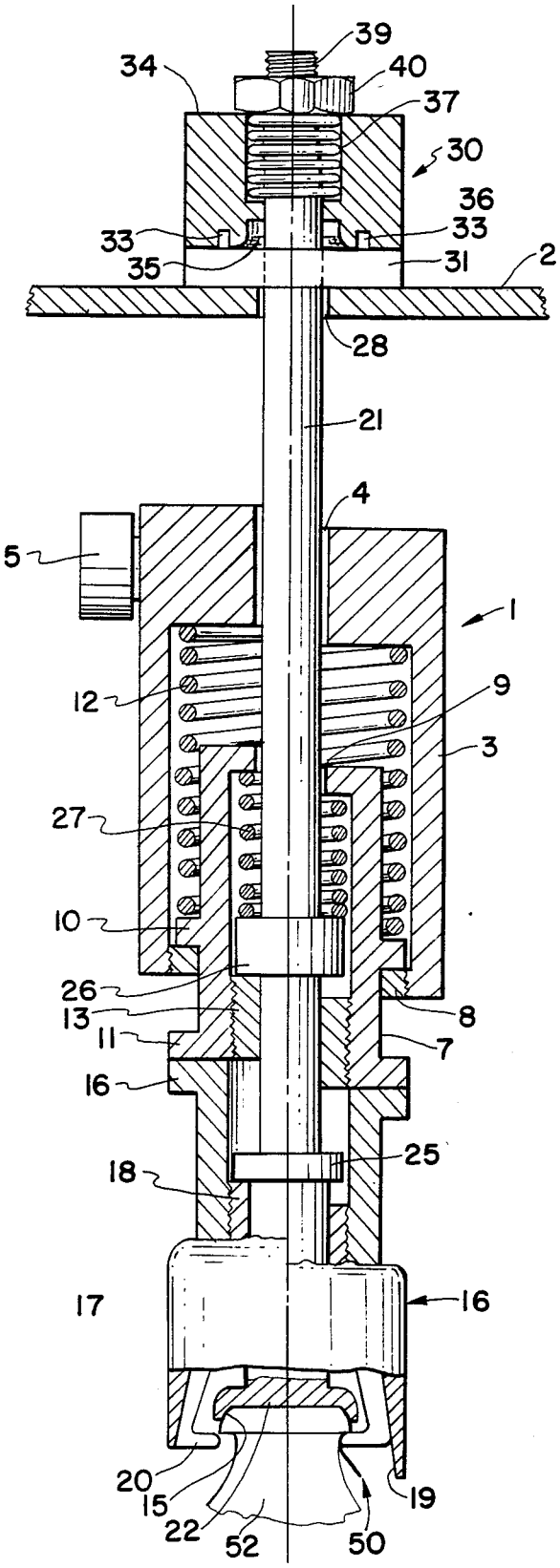
FIG. 2 is a view similar to FIG. 1 showing two advanced capping positions applying a cap to a plastic bottle.
Figure 3:
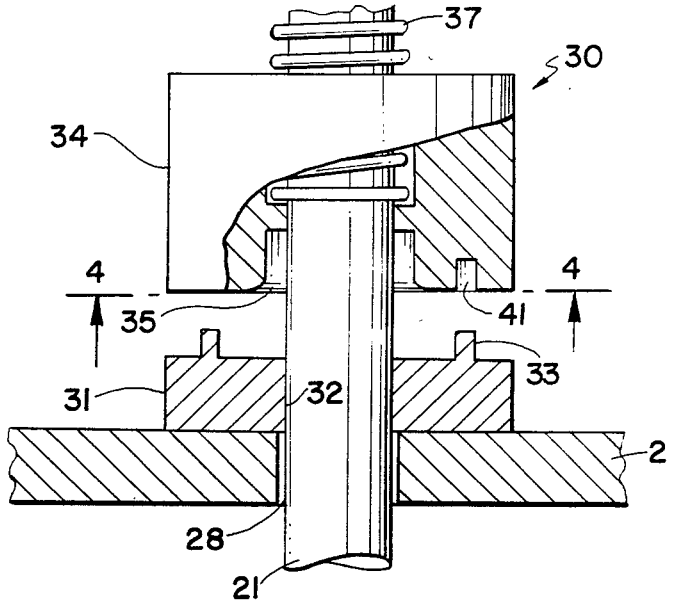
FIG. 3 is an enlarged part elevational part sectional fragmentary showing of the stop mechanism in FIG. 1.

The stop mechanism, as shown in raised position in FIGS. 1 and 2, consists of an elongated key number 31 fixed to the top wall 2 having a central bore 32 and a pair of upstanding spaced pins 33. A movable locking member 34, as shown in FIGS. 1 and 2, rests on top of the key member 31 and is provided with a diametrically extending keyway 35. The base of the keyway has a reduced bore 36 through which the rod 21 extends and is surrounded by a light coil compression spring 37 seated within an enlarged bore 38. The uppermost end of rod 21 has a screw thread 39 for reception of an adjustable stop nut 40. Spring 37 then acts between the locking number 34 and the stop nut 40 to retain the locking number firmly seated on the key member 31. As seen in FIG. 3 movable member 34 has a pair of spaced holes 41 diametrically aligned 90° to the keyway 35 for reception of the pins 33. This engagement prevents relative rotational movement with the locking member in the raised FIG. 1 position. A second set of spaced holes 42 are also diametrically aligned within the keyway 35 for locking the movable member 34 in a rotated lower position as described hereinafter.

Turning to the operation of the bottle capping apparatus, as seen in FIG. 1, a metal tear off cap 50 having a sealing gasket 51 is initially placed on the neck of a semirigid plastic bottle 51. The capping unit 1 is then lowered onto the cap and bottle due to the travel of cam follower 5 along the cam race 6. The left hand side of FIG. 2 shows the crimping head 16 in seated position on the bottle neck 52. At this point in the downward travel of the capping unit 1, neither the compensator spring 12 nor the plunger spring 27 are brought under additional compression. The cap nest 22, however, exerts a sufficient downward force on the bottle to firmly seat the cap thereon and compress the cap gasket prior to crimping. This predetermined fixed travel distance of the plunger rod 21 is set by the dual position stop mechanism 30 which, as seen in FIGS. 1 and 2, is in its raised or active position. The adjustable stop nut 40 contacts the movable member 34 at the lowermost limit of travel compressing the retaining spring 37. A precise positioning of the cap nest 22 is thus achieved for optimum gasket compression and subsequent sealing without crushing or harmfully deforming the plastic bottle.

Even though the plunger rod 21 reaches its predetermined fixed limit of downward travel and is positively restrained against any further movement by the stop nut 40, the outer cylindrical member continues to move downwardly. This further advanced position, as seen in the right hand side of FIG. 2, causes a compression of the plunger 27 as the compensator slide 7 is urged downwardly against the relatively heavy compensator spring 12. This short distance of overtravel lowers the crimping head housing 17 relative to the capping nest 22 causing the internal cam surface 19 to pivot the jaws 20 radially inwardly. The horizontal force component exerted by the camming surface 19 is accordingly employed to crimp the cap 50 onto the bottle neck 52 while the vertical force component is counteracted by the stop mechanism 30. To assure complete closing of the crimping annulus despite minor variations in the bottle neck circumference, such as ovality in the lip of the bottle, an additional increment of radial force is applied by slight compression of the large compensator spring 12 causing relative movement between the compensator slide 7 and the outer cylindrical member 3. Here again, however, the vertical force component is effectively counteracted by the stop mechanism 30 so that no additional vertical loading is applied to the bottle.

To complete the cycle, upward movement of the cam follower 5 restores the various elements of the capping unit 1 to their initial position. Continuous cycling of the capping unit with the stop mechanism 30 in the raised or active mode is fully effective for capping lightweight semirigid plastic bottles which due to their relative resilience and narrow height dimension tolerance can be capped with a fixed vertical setting.

Figure 5:
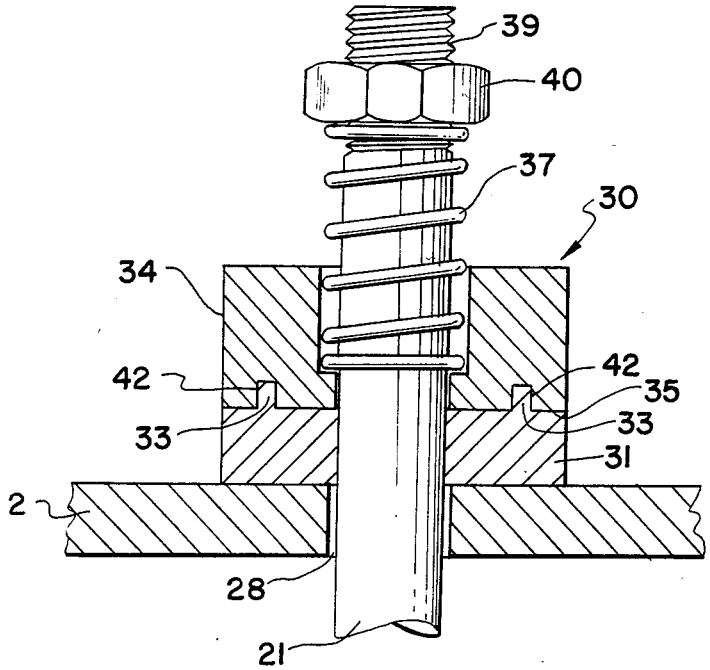
FIG. 5 is a view similar to FIG. 4 showing the stop mechanism in the glass capping mode.
Figure 4:
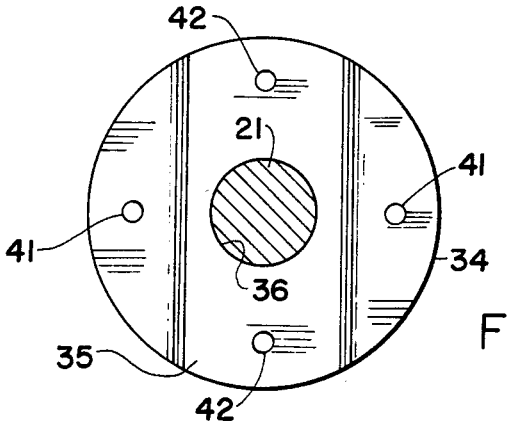
FIG. 4 is a view taken along lines 4—4 in FIG. 3.

Glass bottles by contrast are obviously extremely rigid and normally manufactured within a relatively wide height tolerance. These conditions make the above described plastic bottle capping mode unsuited for also capping glass bottles. Accordingly, to convert the capping unit 1 for the application of closure caps to glass bottles, the movable locking member 34 of the stop mechanism 30 is simply lifted upwardly overcoming the compressive force of retaining spring 37. As soon as the pins 33 on key member 31 clear the holes 41 in locking member 34, as shown in FIG. 4, the locking member is rotated 90° so that the keyway 35 is diametrically aligned with key member 31 and release under the urging of spring 37. In this position, shown in FIG. 5, the key member 31 is received within the keyway 35 with pins 33 now projecting into the holes 42. With the stop mechanism now set in the glass bottle capping mode or inactive position, the capping unit 1 is free to operate in the conventional manner. That is to say, there is no restraint against downward vertical movement of the plunger rod 21 as the stop nut 40 remains at all times out of contact with the movable member 34. This then permits the resulting entire vertical force component to be exerted by the cap nest as is required for capping glass bottles.

Various other changes in or modifications of the bottle capping apparatus and method and different embodiments of the invention would suggest themselves to those skilled in the art and could be made without departing from the spirit or scope of the invention. It is, accordingly, intended that all matter contained in the above description or shown in the accompanying drawing shall be interpreted as being illustrative and not in a limiting sense.

We claim:

1. Apparatus for interchangeably mechanically capping both glass and semirigid containers comprising a vertically fixed support wall, an axially reciprocating cap applying head mounted on said support wall, said head having a centrally disposed cap seating means and circumferentially disposed cap deforming means surrounding said cap seating means, drive means for axially advancing said cap applying head relative to said support wall into capping position, a single, quick release dual position stop means acting between said support wall and said cap applying head for controlling said axial advancement including a first unrestrained preset position for capping glass bottles and a second restrained preset position for capping semirigid containers.

2. Apparatus as in claim 1 and mounting said dual position stop means on said housing.

3. Apparatus as in claim 1 and said stop means first position permitting axial advancement of said cap applying head a distance greater than the distance permitted by said second position.

4. Apparatus as in claim 1 and including biasing means for urging said stop means into either preset position.

* * * * *